US007018176B2

(12) United States Patent
Mongillo et al.

(10) Patent No.: US 7,018,176 B2
(45) Date of Patent: Mar. 28, 2006

(54) COOLED TURBINE AIRFOIL

(75) Inventors: Dominic J. Mongillo, West Hartford, CT (US); Shawn J. Gregg, Wethersfield, CT (US); Ruthann Mercadante, Wethersfield, CT (US)

(73) Assignee: United Technologies Corporation, Hartford, CT (US)

( * ) Notice: Subject to any disclaimer, the term of this patent is extended or adjusted under 35 U.S.C. 154(b) by 117 days.

(21) Appl. No.: 10/840,546

(22) Filed: May 6, 2004

(65) Prior Publication Data

US 2005/0249583 A1 Nov. 10, 2005

(51) Int. Cl.
*F01D 25/12* (2006.01)

(52) U.S. Cl. ..... 416/97 R; 415/115

(58) Field of Classification Search ..... 415/115; 416/97 R

See application file for complete search history.

(56) References Cited

U.S. PATENT DOCUMENTS 4,767,268 A * 8/1988 Auxier et al. ..... 416/97 R
5,356,265 A * 10/1994 Kercher ..... 416/97 R
5,669,759 A * 9/1997 Beabout ..... 416/97 R

* cited by examiner

*Primary Examiner*—Ninh H. Nguyen

(57) ABSTRACT

According to the present invention, a hollow airfoil is provided that comprises a leading edge wall portion, a plurality of cavities, one or more crossover ribs, a plurality of cooling apertures, and a plurality of impingement ribs. The cavities are disposed adjacent the leading edge wall portion, between the leading edge wall portion and a first rib. The crossover ribs extend between the leading edge wall portion and the first rib, and at least one crossover rib is disposed between a pair of the cavities. The cooling apertures are disposed in the leading edge wall portion, providing a passage through which cooling air can exit the cavities. The impingement apertures are disposed in the first rib, providing a passage through which cooling air can enter the cavities. At least one of the impingement apertures is contiguous with one of the crossover ribs.

7 Claims, 3 Drawing Sheets

FIG. 1
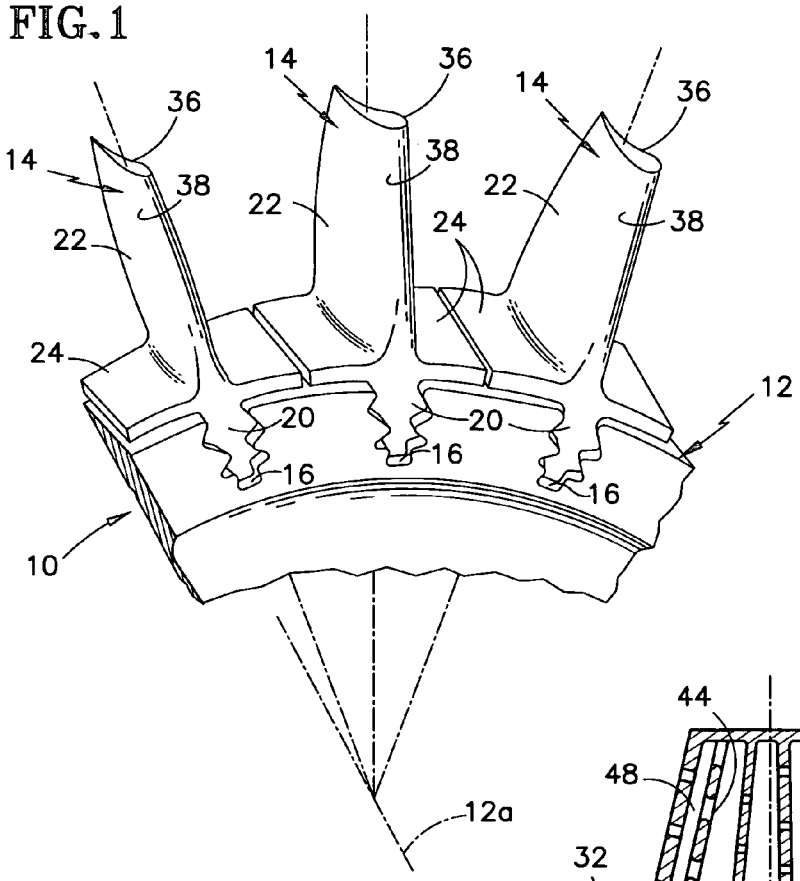
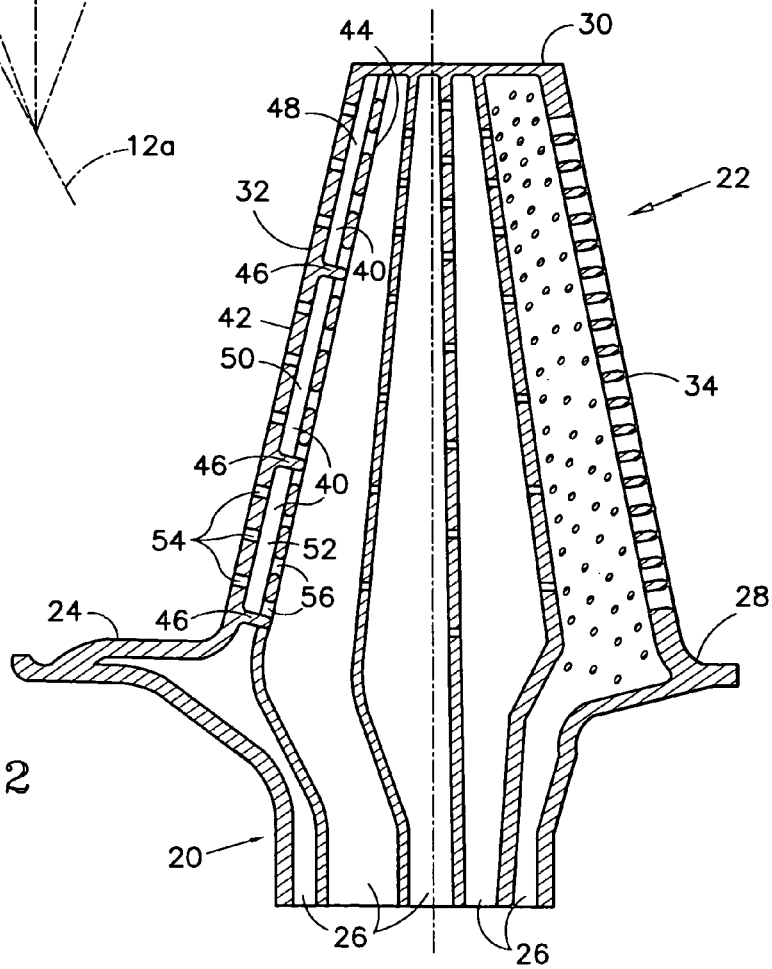
FIG. 2

COOLED TURBINE AIRFOIL

The invention was made under a U.S. Government contract and the Government has rights herein.

BACKGROUND OF THE INVENTION

1. Technical Field

This invention applies to turbine airfoils in general, and to cooled turbine airfoils in particular.

2. Background Information

Turbine and compressor sections within an axial flow turbine engine generally include rotor assemblies and stator assemblies. The rotor assemblies each comprise a rotating disc and a plurality of rotor blades circumferentially disposed around the disk. The stator assemblies each comprise a plurality of stator vanes that may be movable in part or in whole, but do not rotate circumferentially. Stator vanes and rotor blades include an airfoil portion for positioning within the gas path through the engine. Because the temperatures within the gas path very often negatively affect the durability of the airfoil, it is known to cool an airfoil by passing cooling air through the airfoil. The cooled air helps decrease the temperature of the airfoil material and thereby increase its durability. What is needed, therefore, is an airfoil having an internal configuration that promotes desirable cooling of the airfoil and thereby increases its durability.

DISCLOSURE OF THE INVENTION

According to the present invention, a hollow airfoil is provided that comprises a leading edge wall portion, a plurality of cavities, one or more crossover ribs, a plurality of cooling apertures, a first rib, and a plurality of impingement apertures. The cavities are disposed adjacent the leading edge wall portion, between the leading edge wall portion and the first rib. The crossover ribs extend between the leading edge wall portion and the first rib, and each crossover rib is disposed between a pair of the cavities. The cooling apertures are disposed in the leading edge wall portion, providing a passage through which cooling air can exit the cavities. The plurality of impingement apertures are disposed in the first rib, providing a passage through which cooling air can enter the cavities. At least one of the impingement apertures is contiguous with one of the crossover ribs.

Prior art cooling configurations, as shown in FIG. 4, include a geometry wherein the impingement holes are separated a distance from the crossover ribs. There are several drawbacks to such a configuration. First, the separation distance creates a pair of pockets 63 wherein cooling air recirculation zones 62 can form. A recirculation zone 62 is characterized by cooling air that circulates for a relatively substantial time before exiting. As a result, the airfoil material adjacent the recirculation zone does not cool adequately, and eventually oxidizes and degrades, consequently impairing the ability of the airfoil to function. The present invention eliminates the pockets where the recirculation zones 62 form and thereby provides favorable heat transfer of the region adjacent the crossover rib 46 and protection against oxidation.

Another drawback of the aforesaid prior art cooling configuration occurs during the manufacturing process. Very often, leading edge cooling apertures are formed using a laser drilling process that requires backing material be inserted into the cavities prior to drilling to avoid back strike by the laser. The backing material is removed after the drilling process is complete. In some instances, however, the backing material is not completely removed from the pockets. The residual backing material impedes cooling within the pocket(s). As a result, the airfoil material adjacent the pockets is not cooled properly and is subject to undesirable oxidation and degradation. The present invention eliminates the pockets where the residual backing material resides and thereby prevents the undesirable residual material.

Another drawback of the prior art configuration is associated with the casting cores used to create the airfoils. The prior art cooling hole/cavity geometry shown in FIG. 4 requires a ceramic core geometry that includes small extensions that create the voids that become the pockets in the final product. The small extensions are susceptible to mechanical damage (e.g., fracture) due to loading that occurs during the casting process wherein molten material under pressure is injected into the mold. The small extensions are also susceptible to mechanical damage that occurs due to heat transfer during the casting process. The difference in mass between larger portions of the ceramic core and smaller portions of the core (i.e., those used to create the small extensions) causes the different portions to heat and cool at different rates. As a result, stress within the ceramic core can cause undesirable mechanical failure. In both instances, the producibility of the airfoil is negatively affected. The present invention eliminates the small extensions used to create the pockets and consequently the problems associated therewith.

These and other objects, features and advantages of the present invention will become apparent in light of the detailed description of the best mode embodiment thereof, as illustrated in the accompanying drawings.

BRIEF DESCRIPTION OF THE DRAWINGS

FIG. 1 is a partial perspective view of a rotor assembly.

FIG. 2 is a diagrammatic sectioned rotor blade.

DETAILED DESCRIPTION OF THE INVENTION

Figure 3:
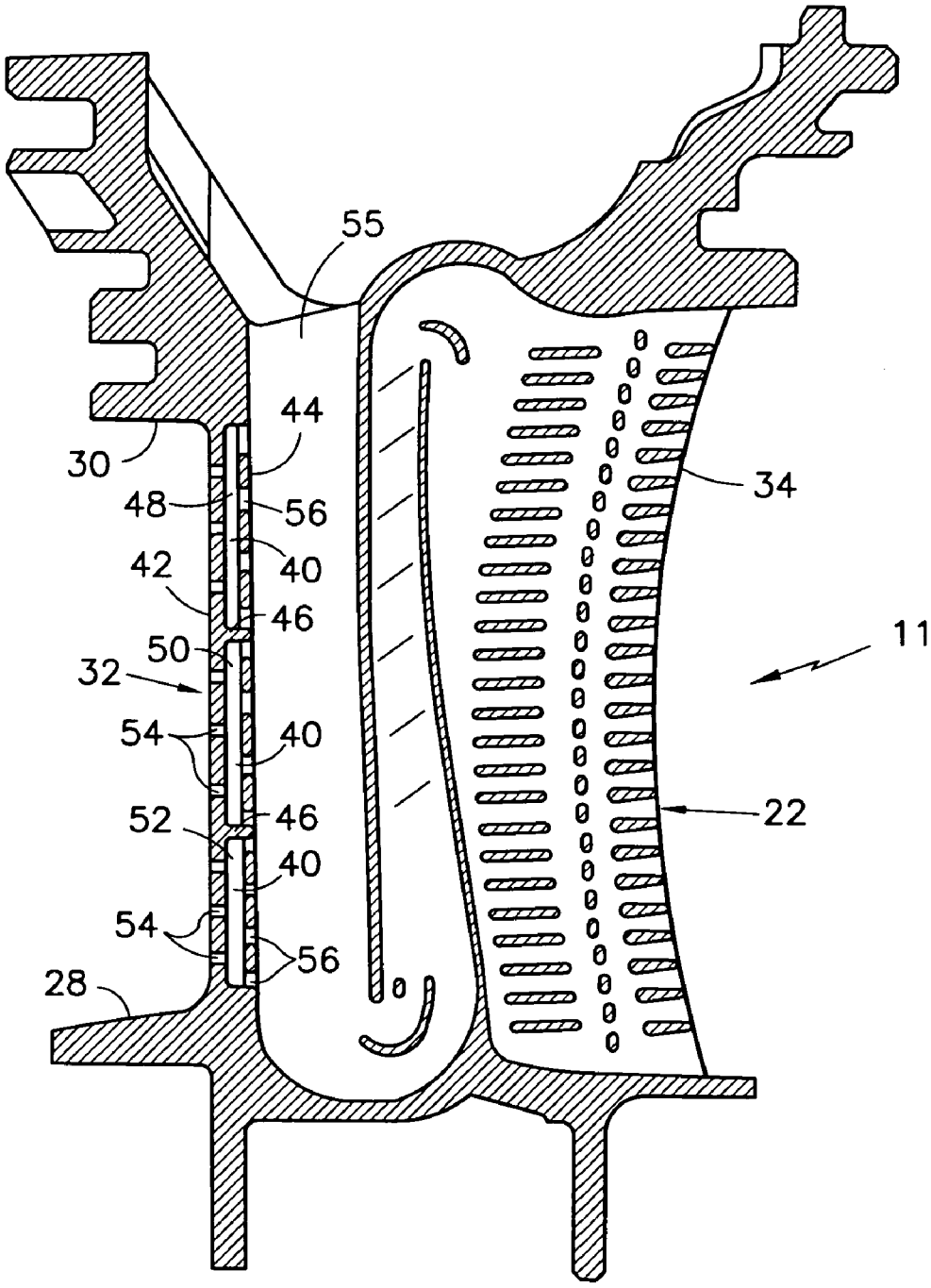
FIG. 3 is a diagrammatic sectioned stator vane.

Referring to FIG. 1, a rotor blade assembly 10 for a gas turbine engine is provided having a disk 12 and a plurality of rotor blades 14. The disk 12 includes a plurality of recesses 16 circumferentially disposed around the disk 12 and a rotational centerline 12*a* about which the disk 12 may rotate. Each blade 14 includes a root 20, an airfoil 22, and a platform 24. The root 20 includes a geometry that mates with that of one of the recesses 16 within the disk 12. A fir tree configuration is commonly known and may be used in this instance. As can be seen in FIG. 2, the root 20 further includes conduits 26 through which cooling air may enter the root 20 and pass through into the airfoil 22. FIG. 3 diagrammatically shows a stator vane 11 having an airfoil 22. The structure described below as a part of airfoil 22 can be incorporated in either a rotor blade 14, a stator vane 11, or other structure found within a gas turbine engine, as is therefore not limited to the embodiments provided in this detailed description.

Referring to FIGS. 2 and 3, the airfoil 22 includes a base 28, a tip 30, a leading edge 32, a trailing edge 34, a pressure side wall 36 (see FIG. 1), a suction side wall 38 (see FIG. 1), and a plurality of leading edge cavities 40. FIGS. 2 and 3 diagrammatically illustrate an airfoil 22 sectioned between the leading edge 32 and the trailing edge 34. The pressure side wall 36 and the suction side wall 38 extend between the base 28 and the tip 30 and meet at the leading edge 32 and the trailing edge 34.

The leading edge cavities 40 are disposed adjacent the leading edge 32, between a wall portion 42 extending along the leading edge 32 (the "leading edge wall portion") and a first rib 44. One or more crossover ribs 46 extend between the leading edge wall portion 42 and the first rib 44, including at least one crossover rib 46 disposed between a pair of the leading edge cavities 40. The embodiment shown in FIGS. 2 and 3 include a first 48, second 50, and third 52 leading edge cavity. The first leading edge cavity 48 is disposed laterally between the leading edge wall portion 42 and the first rib 44, circumferentially between the suction side wall 38 and the pressure side wall 36, and radially between a crossover rib 46 and the tip 30. The second and third leading edge cavities 50, 52 are disposed similarly except radially where each is disposed between a pair of crossover ribs 46 (the third leading edge cavity 52 of the stator vane 11 is shown radially disposed between the base 28 and a crossover rib 46, but may be disposed between a pair of crossover ribs 46 alternatively).

A plurality of cooling apertures 54 are disposed in the leading edge wall portion 42, spaced apart from one another along the leading edge 32. Each cooling aperture 54 provides a passage through which cooling air can exit the cavities 48, 50, 52. The exact type(s) of cooling aperture 54 can vary depending on the application, and more than one type of cooling aperture 54 can be used. Leading edge cooling apertures 54 are known in the prior art and will not, therefore, be discussed further herein. The present invention can be used with a variety of different cooling aperture types and is not, therefore, limited to any particular type.

Figure 5:
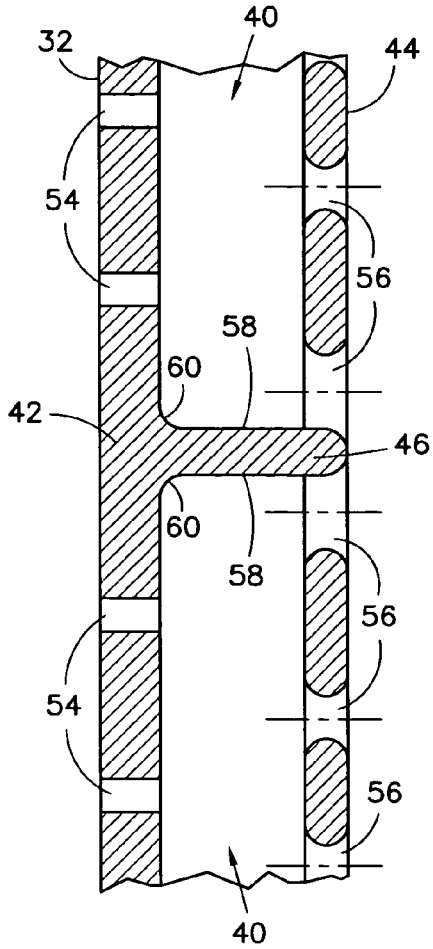
FIG. 5 is a partial sectioned view of the present invention airfoil leading edge. The airfoil may be a part of a rotor blade or a stator vane.

Referring to FIGS. 2, 3, and 5, a plurality of impingement apertures 56 are disposed in the first rib 44. Each impingement aperture 56 provides a passage through which cooling air can enter a cavity 48, 50, 52. The impingement apertures 56 may be aligned with leading edge wall portions 42 that extend between adjacent cooling apertures 54 disposed along the leading edge 32, or they may be aligned with the cooling apertures 54. One or more of the impingement apertures 56 are contiguous with one of the one or more crossover ribs 46. Preferably, impingement apertures 56 are disposed contiguous with crossover ribs 46, on each side that is exposed to cooling air.

Figure 4:
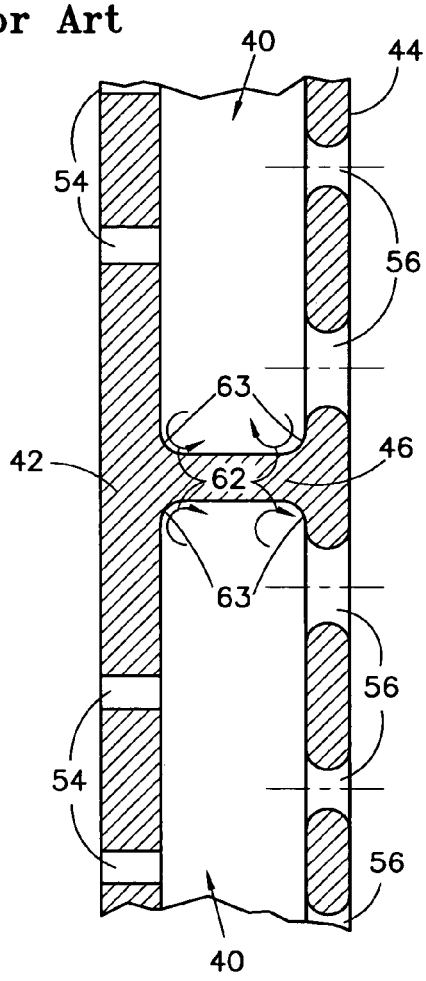
FIG.4 Prior Art
FIG. 4 is a partial sectioned view of a prior art airfoil leading edge.

In the operation of the invention, the airfoil 22 is disposed within the core gas path of the turbine engine typically either as a portion of a stator vane or a rotor blade, although as indicated above the present invention is not limited to those applications. The airfoil 22 is subject to high temperature core gas passing by the airfoil 22. Cooling air, that is substantially lower in temperature than the core gas, is fed into the airfoil 22; e.g., in the rotor blade shown in FIG. 2, cooling air is fed into the airfoil 22 through the conduits 26 disposed in the root 20. In the stator vane 11 shown in FIG. 3, cooling air is fed into the airfoil 22 through an open passage 55. Pressure differences within the airfoil 22 cause the cooling air to enter the leading edge cavities 48, 50, 52 disposed along the leading edge 32. The cooling air enters the cavities 48, 50, 52 through the impingement apertures 56 disposed within the first rib 44 (see FIG. 4). Certain of the impingement apertures 56 are disposed contiguous with a crossover rib 46. In this position, cooling air passing into a cavity 48, 50, 52 through the contiguous impingement aperture 56 travels along a surface 58 of the crossover rib 46. The cooling air traveling along the surface 58 of the crossover rib 46, and subsequently along any fillet 60 that might exist at the intersection of the crossover rib 46 and the leading edge wall portion 42, provides favorable heat transfer of the crossover rib 46, fillet 60, and leading edge wall portion 42, when compared to prior art arrangements.

Although this invention has been shown and described with respect to the detailed embodiments thereof, it will be understood by those skilled in the art that various changes in form and detail thereof may be made without departing from the spirit and the scope of the invention. For example, the present invention is disclosed in the application of a hollow airfoil 22. In alternative embodiments, the present invention may be disposed within other hollow, coolable structures disposed within the core gas flow path of the turbine engine. In addition, the Detailed Description of the Invention discloses the present invention as being disposed adjacent the leading edge 32 on an airfoil 22. In alternative embodiments, the present invention may be disposed elsewhere within the airfoil 22.

What is claimed is:

1. A hollow airfoil, comprising:

a leading edge wall portion;

a plurality of cavities disposed adjacent the leading edge wall portion, between the leading edge wall portion and a first rib;

one or more crossover ribs extending between the leading edge wall portion and the first rib;

a plurality of cooling apertures disposed in the leading edge wall portion, providing a passage through which cooling air can exit the cavities; and a plurality of impingement apertures disposed in the first rib, providing a passage through which cooling air can enter the cavities, wherein at least one of the impingement apertures is contiguous with one of the one or more crossover ribs.

2. The hollow airfoil of claim 1, wherein the airfoil is a part of a rotor blade.

3. The hollow airfoil of claim 2, wherein the plurality of cavities includes a first cavity, a second cavity, and a third cavity, and a first crossover rib is disposed between the first cavity and the second cavity, and a second crossover rib is disposed between the second cavity and the third cavity;

wherein first impingement apertures are disposed in the first rib on each side of at least one of the first crossover rib and second crossover rib, both contiguous with the at least one of the first crossover rib and second crossover rib.

4. The hollow airfoil of claim 1, wherein the airfoil is a part of a stator vane.

5. The hollow airfoil of claim 4, wherein the plurality of cavities includes a first cavity, a second cavity, and a third cavity, and a first crossover rib is disposed between the first cavity and the second cavity, and a second crossover rib is disposed between the second cavity and the third cavity;

wherein first impingement apertures are disposed in the first rib on each side of at least one of the first crossover rib and second crossover rib, both contiguous with the at least one of the first crossover rib and second crossover rib.

6. A hollow airfoil, comprising:

a plurality of cavities, between a wall portion and a first rib;

one or more crossover ribs extending between the wall portion and the first rib;

a plurality of cooling apertures disposed in the wall portion, providing a passage through which cooling air can exit the cavities; and a plurality of impingement apertures disposed in the first rib, providing a passage through which cooling air can enter the cavities, wherein one or more of the impingement apertures is contiguous with one of the one or more crossover ribs.

7. A hollow coolable turbine component, comprising:

a plurality of cavities disposed adjacent a wall portion, between the wall portion and a first rib;

one or more crossover ribs extending between the wall portion and the first rib;

a plurality of cooling apertures disposed in the wall portion, providing a passage through which cooling air can exit the cavities; and a plurality of impingement apertures disposed in the first rib, providing a passage through which cooling air can enter the cavities, wherein one or more of the impingement apertures is contiguous with one of the one or more crossover ribs.

* * * * *